US006325455B1

(12) United States Patent
Chung

(10) Patent No.: US 6,325,455 B1
(45) Date of Patent: Dec. 4, 2001

(54) RECLINING CHAIR

(75) Inventor: Shianp J. Chung, Taipei (TW)

(73) Assignee: HoMedics, Inc., Commerce Township, MI (US)

( * ) Notice: Subject to any disclaimer, the term of this patent is extended or adjusted under 35 U.S.C. 154(b) by 0 days.

(21) Appl. No.: 09/569,075

(22) Filed: May 11, 2000

(51) Int. Cl.[7] ..... A47C 1/02

(52) U.S. Cl. ..... 297/327; 297/328; 297/282; 297/423.26

(58) Field of Search ..... 297/68, 282, 327, 297/328, 423.26, 281

(56) References Cited

U.S. PATENT DOCUMENTS

| | | |
|---|---|---|
| 825,984 | 7/1906 | Schmershal . |
| 4,790,599 | 12/1988 | Goldman . |
| 5,110,179 | 5/1992 | Rogers . |
| 5,120,107 | 6/1992 | Rogers, Jr. . |
| 5,143,055 | 9/1992 | Eakin . |
| 5,156,441 | 10/1992 | Byersmith et al. . |
| 5,244,252 | 9/1993 | Serber . |
| 5,249,838 | 10/1993 | Kulpa et al. . |
| 5,261,725 | 11/1993 | Rudolph . |
| 5,388,886 | 2/1995 | LaPointe et al. . |
| 5,460,427 | 10/1995 | Serber . |
| 5,498,055 | 3/1996 | Goldman . |
| 5,582,457 | 12/1996 | Komorowski et al. . |
| 5,605,372 | 2/1997 | Al-Abdullateef . |
| 5,845,961 | 12/1998 | LaPointe et al. . |
| 5,984,409 * | 11/1999 | Eakin et al. ..... 297/327 X |

OTHER PUBLICATIONS

Paradiso Relax—und Massagesessel, HMF Heddernheimer Metallwarenfabrik GmbH.
Relaxing & Massage Chair, Hardness Co., Limited.

* cited by examiner

*Primary Examiner*—Anthony D. Barfield
(74) *Attorney, Agent, or Firm*—Brooks & Kushman P.C.

(57) ABSTRACT

A reclining chair including a seat frame and a base is disclosed. The seat frame is suspended from pivot connectors that are connected between right and left side stand members and right and left sides of the seat frame by means of plates that include a arcuate slot. Locking members are received in the slots and are used to lock the seat frame relative to the base in a range of angular orientations as defined by arcuate slots formed in the plates. The seat frame is spring biased into an upright position when the locking members are released.

6 Claims, 3 Drawing Sheets

RECLINING CHAIR

TECHNICAL FIELD

The present invention relates to reclining chairs having a base to which the frame of the reclining chair may be locked at a desired angle of inclination.

BACKGROUND ART

Reclining chairs provide a comfortable seating alternative that may permit a person to raise and hold their legs above their heart to provide therapeutic benefits.

Many different types of reclining chairs have been developed with different features and different levels of complexity. One example of a reclining chair is shown in U.S. Pat. No. 5,845,961 that has a positionable footrest with a complex linkage mechanism . This type of reclining chair utilizes an extensive linkage having multiple parts and must be assembled together in precise alignment. Improper use or unbalanced loading can cause this type of reclining chair to become misaligned or wear out over time.

Another example of a reclining chair is disclosed in U.S. Pat. No. 4,790,599. This type of pivoting recliner utilizes curved guide members having curved slots, that form a part of the base frame of the chair. This chair is supported on elongated bars that pivot within limits defined by arcuate slots in the curved guide members. While this structure is somewhat simplified compared to multilink structures described above, it is still unduly complex. The pivot mechanism disclosed in this patent has pinch points between the arm members and the frame that can result in a user suffering a painful injury when the angle of inclination of the seat is adjusted. In addition, the footrest is connected to the seat portion of the seat in a rigid non-adjustable manner. The adjustment nob is also difficult to use because it pivots with the seat instead of remaining stationary relative to the base.

These and other problems are addressed by the invention as summarized below.

DISCLOSURE OF INVENTION

According to the present invention, a reclining chair is provided that comprises a seat frame including a seat back, a seat base, and footrest, that are supported by a base including right and left side stand members. The side stand members each have a brace located below the top of the side stand member. Pivot connectors connect right and left side stand members to the seat frame in a range of angular orientations. Each of the pivot connectors comprise a plate that is fixedly secured to one side of the seat frame and extends vertically upwardly from the seat frame. Each plate is connected by a fixed pivot connection to one of the side stand members. Each plate also has an arcuate slot spaced below the fixed pivot connection. The locking members are secured to the braces and extend through the arcuate slot in the plate. The locking members may be released to allow the seat frame to pivot on the side stand members with the plate moving relative to the locking members and with the arcuate slot guiding and limiting the movement of the plate relative to the locking members. The locking members may be engaged to lock the seat frame to the side stand members.

According to another aspect of the invention a reclining chair is provided that has a footrest connected to the seat base by means of a pivot connection. The footrest may be locked within a range of angular positions relative to the seat base in a desired position. In this way, the reclining chair may be used as a conventional chair by folding the footrest to a position substantially perpendicular to the frame of the seat base.

According to further aspect of the invention, a handle is provided for manually locking and unlocking the locking members. The locking members include a threaded shaft that is received by a threaded member that is turned in one direction to loosen the locking member in the opposite direction to tighten the locking member.

According yet another aspect of the invention, the plate is secured to a reinforcement that connects that seat back and seat base together in a fixed relationship.

According to one form of the invention, a spring is connected between a seat frame and base or brace connected to the base. The spring biases the seat frame to move towards an upright position by exerting a biasing force between the seat frame and base. While one spring may be used to provide the biasing force, to provide a balanced biasing force two springs may be provided with one spring being provided on each side of the seat frame.

These and other objects and advantages in the present invention will be better understood in view of the attached drawings and following detailed description of the invention.

BEST MODE FOR CARRYING OUT THE INVENTION

Figure 1:
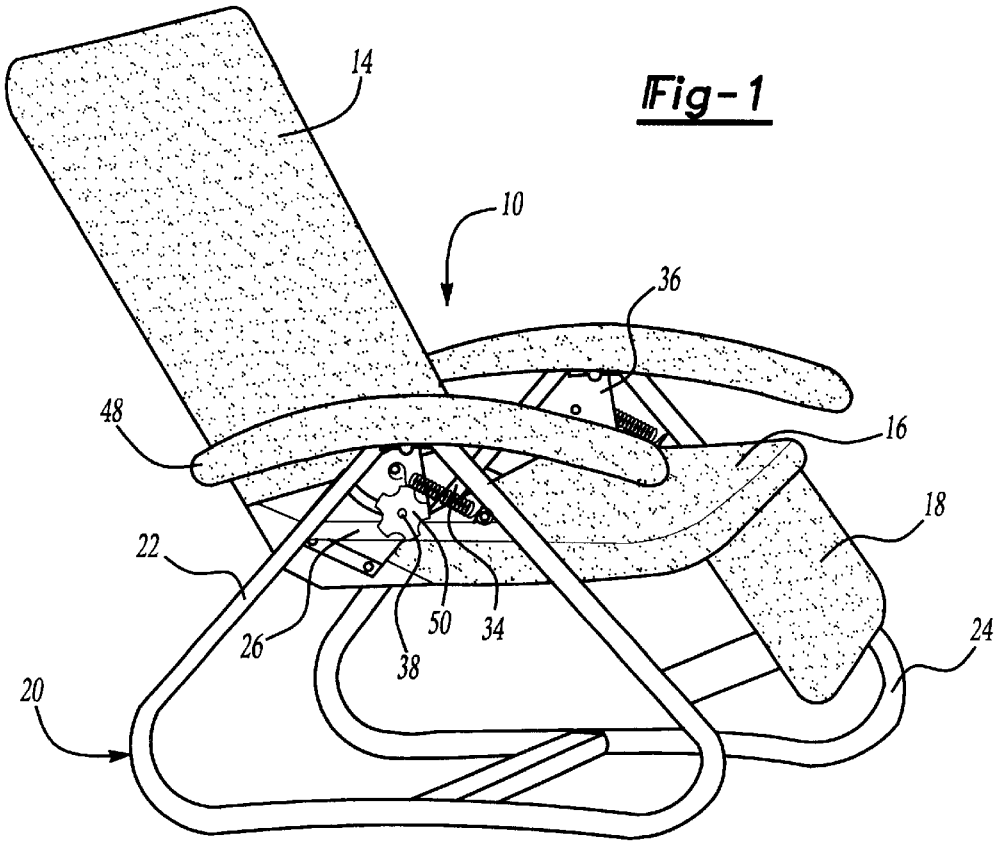
FIG. 1 is a perspective view of a reclining chair made in accordance with the present invention.
Figure 2:
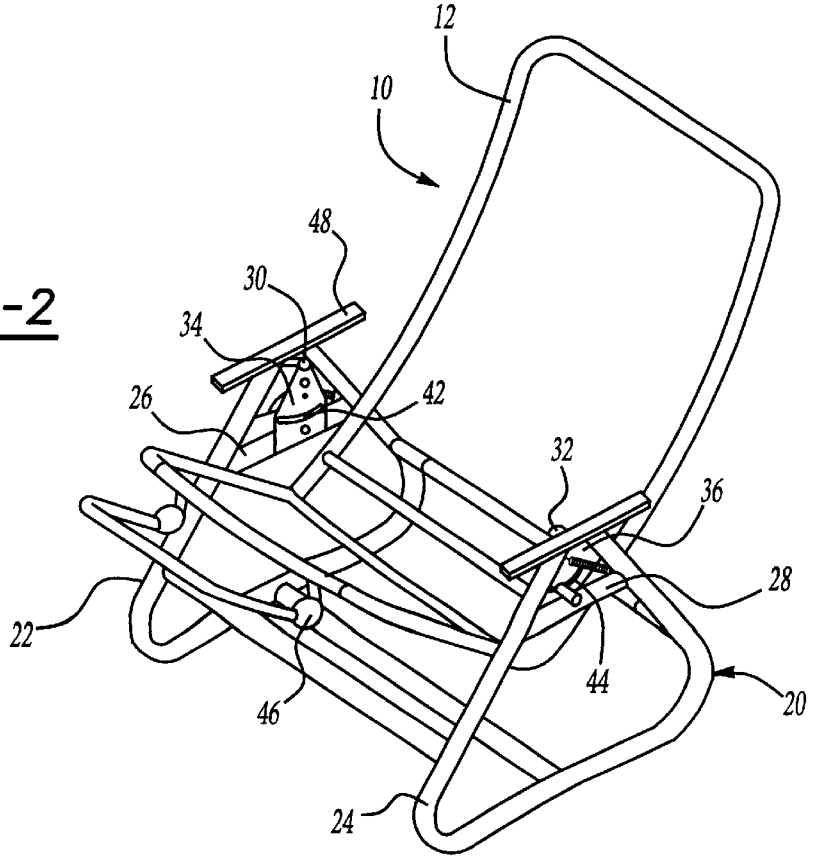
FIG. 2 is a perspective view of a reclining chair with the seat pad and arm rests removed.

Referring now to FIGS. 1 and 2, the reclining chair 10 of the present invention is shown to include a seat frame 12 upon which a seat back 14 and seat base 16 are secured. A footrest 18 is connected to the seat frame 12 adjacent to seat base 16. A base 20 is provided for the reclining chair 10 that includes a right side stand member 22 and a left side stand member 24. A right brace 26 and left brace 28 are connected to the right and left side stand members 22 and 24, respectively. Right and left pivot connectors 30 and 32 are provided on the upper most portion of right and left side stand members 22 and 24. The right and left braces 26 and 28 extend horizontally across an upper portion of right and left side stand members 22 and 24.

The right and left pivot connectors 30 and 32 include right and left plates 34 and 36 that extend downwardly from the right and left pivot connectors 30 and 32, respectively, and are secured to the seat frame 12. Right and left locking members 38 and 40 are provided on opposite sides of the base 20 and are adapted to lock the seat frame 12 relative to the base 20 by securing the right and left plates 34 and 36 to the right and left braces 26 and 28. Right and left arcuate slots 42 and 44 are formed in right and left plate 34 and 36, respectively, to receive right and left locking members 38 and 40. Right and left locking members 38 and 40 may be selectively released and permitted to move within right and left slots 42 and 44. This allows the right and left plates 34 and 36 to swing on the right and left pivot connectors 30 and 32 as the seat frame 12 is moved to different angular orientations within a range of angular orientations defined by right and left slots 42 and 44.

A selectively lockable footrest pivot connector 46 connects the footrest 18 to the seat base 16. The footrest pivot connector 46 allows the footrest to be moved from the generally vertical orientation illustrated in FIG. 1 to the position shown in FIG. 2 wherein the footrest 18 is generally parallel to the plane of the seat base 16. Armrests 48 are provided on the upper part of the right and left side stand members 22 and 24 of the base 20.

Figure 3:
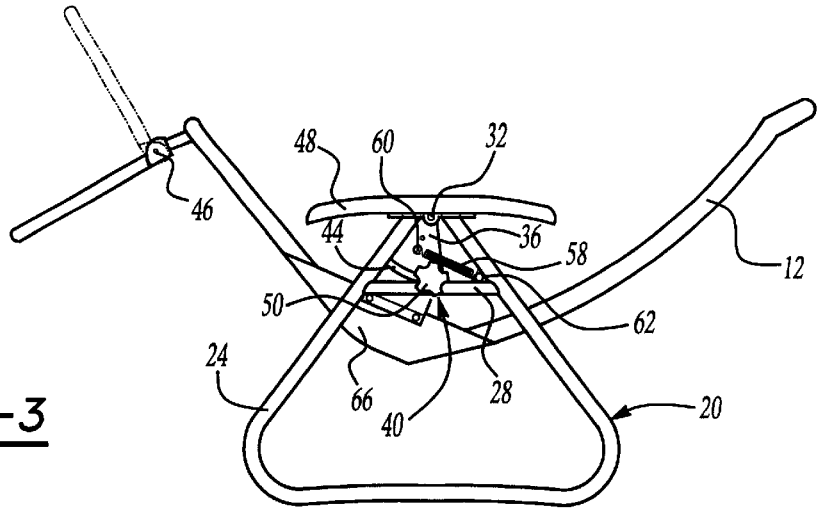
FIG. 3 is a side elevation view of the reclining chair of the present invention in the reclined position.
Figure 4:
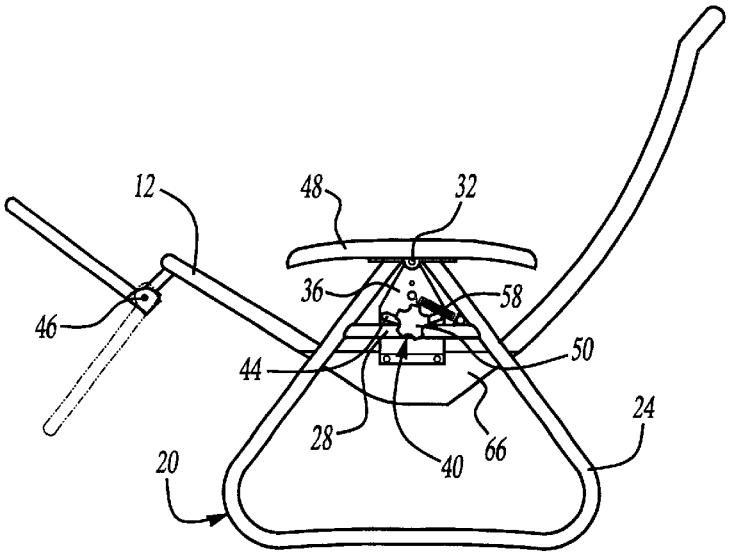
FIG. 4 is a side elevation view of the reclining chair of the present invention in the midpoint position.
Figure 5:
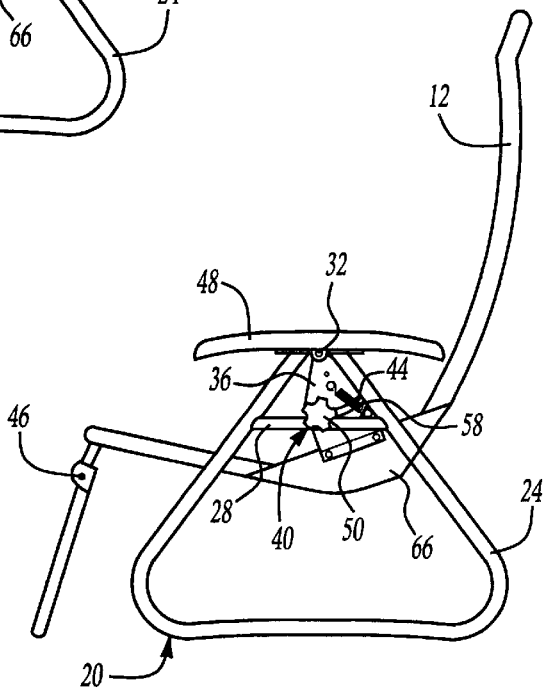
FIG. 5 is a side elevation view of the reclining chair of the present invention in the upright position.

Referring now to FIGS. 3–5, reclining chair 10 is shown to include a seat frame 12 to which the seat back 14 and 16 may be attached. The footrest 18 is shown in two positions in FIGS. 3 and 4 and in a single position in FIG. 5. In FIG. 3, the reclining chair 10 is shown in its full reclined position wherein the footrest 18 may be either parallel to the seat base 16 or essentially perpendicular to the seat base 16. In FIG. 4, the reclining chair 10 is shown in its midpoint position with the left locking member 40 in the midpoint of the left slot 44 in the left plate 36. The left plate 36 is shown suspended directly below the left connector 32. In FIG. 5, the reclining chair 10 is shown in its full upright position with the footrest 18 in the position wherein it extends perpendicularly downwardly from the seat base 16. In the position shown in FIG. 5 the reclining chair 10 may be used in a manner similar to a conventional chair. The reclining chair may be locked in any of the position shown in FIGS. 3 through 5 or in other intermediate positions.

Figure 6:
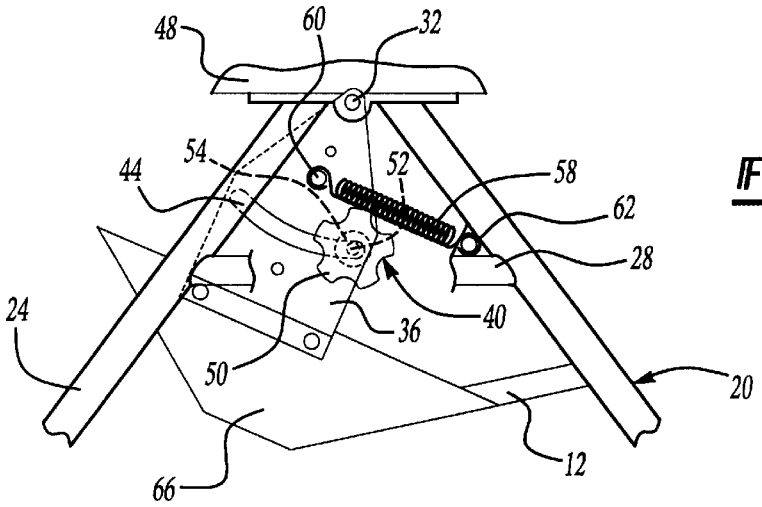
FIG. 6 is a fragmentary side elevation view showing the pivot connector when the chair is in its reclined position.
Figure 7:
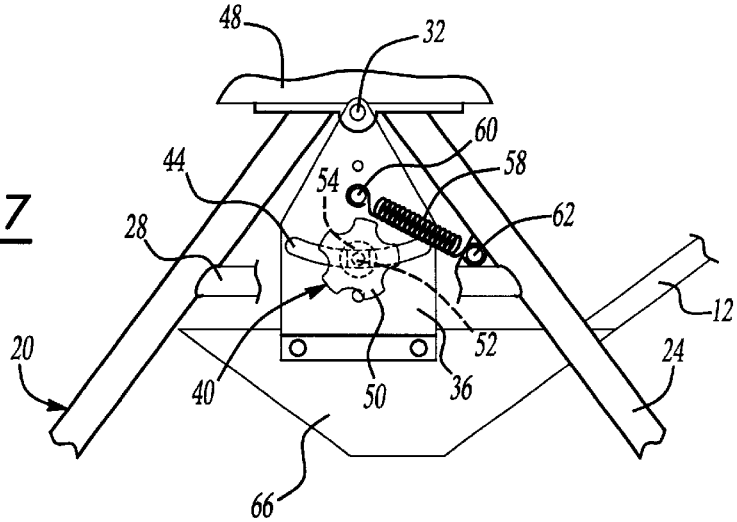
FIG. 7 is a fragmentary side elevation view showing the pivot connector when the chair is in its midpoint position.
Figure 8:
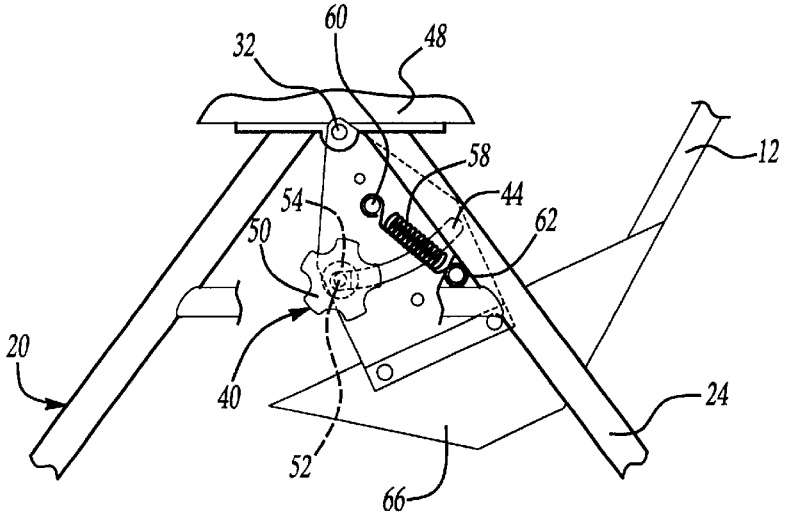
FIG. 8 is a fragmentary side elevation view showing the pivot connector when the chair is in its upright position.

Referring now to FIG. 6, the left pivot connector is shown in the fully reclined position corresponding to FIG. 3. In FIG. 7 the left pivot connection is shown in the intermediate position shown in FIG. 4. In FIG. 8 the left pivot connection is shown in the upright position corresponding to FIG. 5.

Referring now to FIGS. 6–8, a handle 50 that is gripped by a user and turned to lock and unlock the left locking member 40 as shown. The handle 50 is connected to a threaded shaft 52 that is received by a nut 54 or other internally threaded locking member.

A spring 58 extends from a pin 60 on the chair to a pin 62 on the base. Pin 62 is shown secured between the left brace 28 and the left side stand member 24. The spring 58 exerts a biasing force on the seat frame 12 through the left plate 36 causing the chair to be biased into the upright position shown in FIG. 8.

A reinforcement 66 is part of the seat frame 12 and reinforces the frame adjacent the seat back 14 and seat base 16 holding them in a fixed relationship to each other.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A reclining chair comprising:

a seat frame including a seat back, a seat base, and a footrest;

a base including right and left side stand members, each of the side stand members having a brace on each side stand member located below the top of each of the respective side stand members;

a pair of pivot connectors connecting right and left sides of the seat frame and base together in a range of angular orientations, each of the pivot connectors comprising a single plate fixedly secured to one side of the seat frame and extending vertically upwardly from the seat frame, the plate having a fixed pivot connection to one of the side stand members, the plate also having an arcuate slot spaced below the fixed pivot connection;

a pair of locking members each secured to one of the braces and extending through the arcuate slot, wherein the locking members may be released to allow the seat frame to pivot on the side stand members with the plate moving relative to the locking members and with the arcuate slot guiding and limiting the movement of the plate relative to the locking members, the locking members are engaged to lock the seat frame to the side stand members; and wherein a spring is connected between at least one of the plates and the brace on the same side as the plate, the spring being mounted to exert a biasing force on the seat frame to cause the seat frame to move to an upright position.

2. The reclining chair of claim 1 wherein the footrest is connected to the seat base by a pivot connection that is moveable within a range of angular positions relative to the seat base and that is capable of being temporarily locked in a desired position with the range of angular positions.

3. The reclining chair of claim 1 wherein the pair of locking members include a handle connected to a threaded shaft that is received by a threaded member, wherein the handle may be manually turned in one direction to loosen the threaded shaft in the threaded member to release the seat frame for pivoting movement relative to the side stand members and turned in the opposite direction to tighten locking member thereby locking the seat frame in a desired position relative to the side stand members.

4. The reclining chair of claim 1 wherein the plate is secured to a reinforcement that connects the seat back and seat base together in a fixed relationship.

5. The reclining chair of claim 1 wherein two springs are provided with one spring being located on each side of the seat frame.

6. A reclining chair comprising:

a seat frame including a seat back, and a seat base;

a base including right and left side stand members, each of the side stand members having a brace located below the top of each of the respective side stand members;

a pair of pivot connectors connecting right and left sides of the seat frame and base together in a range of angular orientations, each of the pivot connectors comprising a single plate fixedly secured to one side of the seat frame and extending upwardly from the seat frame, each plate having a pivot connection to one of the side stand members; and wherein a spring is operatively connected between the seat frame and the base, the spring being mounted to exert a biasing force on the seat frame to cause the seat frame to move to an upright position.

* * * * *